US006766536B1

(12) United States Patent
Aarons

(10) Patent No.: US 6,766,536 B1
(45) Date of Patent: Jul. 27, 2004

(54) YOGA SUPPORT SYSTEM AND METHOD

(76) Inventor: Martha I. Aarons, 2221 Tudor Dr., Cleveland Heights, OH (US) 44106

( * ) Notice: Subject to any disclaimer, the term of this patent is extended or adjusted under 35 U.S.C. 154(b) by 0 days.

(21) Appl. No.: 10/375,232

(22) Filed: Feb. 27, 2003

(51) Int. Cl.[7] ..... A41D 19/00
(52) U.S. Cl. ..... 2/161.3; 36/59 R; 36/114
(58) Field of Search ..... 2/160, 163, 161.1–161.4, 2/161.6, 167, 168; 36/114, 117.3; 482/44, 79, 148, 907

(56) References Cited

U.S. PATENT DOCUMENTS

| | | | | |
|---|---|---|---|---|
| 4,051,553 A | * | 10/1977 | Howard | 2/20 |
| 4,541,186 A | * | 9/1985 | Mulvihill | 36/114 |
| 4,555,813 A | | 12/1985 | Johnson | |
| 4,621,388 A | * | 11/1986 | Ortolivo | 15/227 |
| 4,651,354 A | * | 3/1987 | Petrey | 2/239 |
| 5,467,484 A | * | 11/1995 | Drescher et al. | 2/161.8 |
| 5,511,248 A | * | 4/1996 | Widdemer | 2/161.3 |
| 5,625,900 A | | 5/1997 | Hayes | |
| 5,774,898 A | * | 7/1998 | Malpee | 2/239 |
| 5,790,980 A | * | 8/1998 | Yewer, Jr. | 2/161.6 |
| 5,991,926 A | | 11/1999 | Lakusiewicz | |
| 6,035,444 A | * | 3/2000 | McGrew | 2/161.6 |
| 6,044,493 A | * | 4/2000 | Post | 2/167 |
| 6,209,138 B1 | | 4/2001 | Kang | |
| 6,408,442 B1 | | 6/2002 | Kang | |
| 6,427,248 B1 | | 8/2002 | Albert | |

OTHER PUBLICATIONS

Gaiam Online Catalog, 2003, yoga sport slippers.*
Nike Kyoto yogafootwear.*
Ryka Zoy Yo Yoga Shoe.*
Internet Reference www.yogasyz.com Yoga Paws.*

* cited by examiner

*Primary Examiner*—Katherine Moran
(74) *Attorney, Agent, or Firm*—Renner, Otto, Boisselle & Sklar, LLP

(57) ABSTRACT

A yoga support system includes a pair of yoga gloves and a pair of yoga slippers. Yoga gloves cover the hands of a yoga practitioner and include anti-skid material on parts of the gloves to enable a yoga practitioner to attain and maintain postures that involve pressing on a floor or wall. In particular, the yoga gloves may include anti-skid portions covering an outer part (further from the midline of the hand) of the yoga practitioner's thumb. The yoga slippers include an anti-skid sole, as well as anti-skid side portions on their sides. The slippers allow a yoga practitioner to maintain contact with the floor with the feet flat on the floor, or with the feet pronated or supinated. Other parts of the yoga gloves and yoga slippers are uncovered fabric, which may be a light, breathable and stretchable material.

27 Claims, 4 Drawing Sheets

YOGA SUPPORT SYSTEM AND METHOD

TECHNICAL FIELD

The invention relates broadly to anti-skid supports for maintaining a person in a specified posture, and relates more specifically to yoga equipment and methods for performing yoga.

DESCRIPTION OF THE RELATED ART

Yoga, its name derived from a Sanskrit word meaning "union", is a practice involving intense concentration, coupled with prescribed postures and/or controlled breathing. Yoga originated over 5,000 years ago in India. Over recent decades, it has achieved increasing popularity worldwide, as a method of physical-discipline and health maintenance, a body-oriented therapy, and/or a spiritual discipline. Practitioners of yoga (referred to yogis, if male, or as yoginis, if female) often make yoga a regular practice in their lives, spending time daily or several times a week in its performance.

Yoga is often performed in groups, on surfaces such as wood floors, linoleum, tile floors, or carpeting. In addition, individual practitioners often perform yoga activities in their homes or offices, or while on travel, such as in hotel rooms.

Yoga mats or rugs are often used to prevent slipping of a yoga practitioner while attaining and maintaining specified yoga postures. Such postures may involve pressing or pushing with the hands and feet against a floor and/or a wall. It will be appreciated that mats or rugs may help prevent slippage of the practitioner when attaining or maintaining a yoga posture, thus allowing the practitioner to concentrate on proper yoga practice. In addition, yoga mats or rugs may provide insulation from a cold floor surface. Further, yoga mats or rugs may allow a uniform tactile environment for the practitioner, providing a similar interface surface regardless of the floor material where the practitioner performs yoga. Typical mats may be rubber mats approximately 0.25–0.5 inches (3–6 mm) thick.

One disadvantage of yoga mats and rugs is their bulkiness. Such bulkiness makes it a hardship to carry a yoga mat or rug either locally, such as to a yoga class or session, or while the practitioner is on travel.

Accordingly, it will be appreciated that improvements in yoga performance equipment would be desirable.

SUMMARY OF THE INVENTION

According to an aspect of the invention, a glove includes a fabric portion having a fabric exterior surface throughout; and an anti-skid portion having an anti-skid exterior surface throughout. The fabric portion is connected to the anti-skid portion. The fabric portion includes a dorsal part. The anti-skid portion includes an outer thumb part.

According to another aspect of the invention, a method of performing yoga includes the steps of placing a pair of gloves on respective hands of a yoga practitioner, wherein the gloves each includes a glove anti-skid portion; and having the yoga practitioner assume a yoga position. The having includes placing the glove anti-skid surfaces in contact with a rigid surface.

A yoga support system includes a pair of yoga gloves and a pair of yoga slippers. The yoga gloves and the yoga slippers are configured for use simultaneously by a yoga practitioner to prevent slipping by the yoga practitioner. Each of the gloves includes a glove fabric portion; and a glove anti-skid portion connected to the glove fabric portion. The glove fabric portion is connected to the glove anti-skid portion. Each of the yoga slippers includes a slipper fabric portion having a slipper fabric exterior surface throughout; and a slipper anti-skid portion with a slipper anti-skid exterior surface throughout. The slipper anti-skid portion is connected to the slipper fabric portion. The slipper anti-skid portion includes a sole part, and a pair of side parts overlying both sides of the foot of a user.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, which are not necessarily to scale.

DETAILED DESCRIPTION

A yoga support system includes a pair of yoga gloves and a pair of yoga slippers. Yoga gloves cover the hands of a yoga practitioner and include anti-skid material on parts of the gloves to enable a yoga practitioner to attain and maintain postures that involve pressing on a floor or wall. In particular, the yoga gloves may include anti-skid portions covering an outer part (further from the midline of the hand) of the yoga practitioner's thumb. The yoga slippers include an anti-skid sole, as well as anti-skid side portions on their sides. The slippers allow a yoga practitioner to maintain contact with the floor with the feet flat on the floor, or with the feet pronated or supinated. Other parts of the yoga gloves and yoga slippers are uncovered fabric, which may be a light, breathable and stretchable material.

Figure 1:
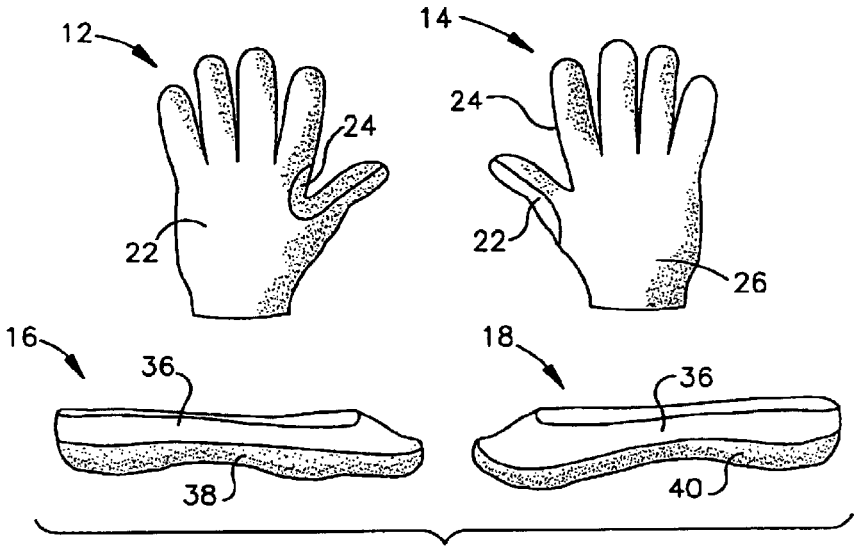
FIG. 1 is a view of a yoga support system in accordance with the present invention.

Referring to FIG. 1, a yoga support set 10 includes a pair of yoga gloves 12 and 14, as well as a pair of yoga slippers 16 and 18. The yoga gloves 12 and 14 may be substantially identical to one another, except for differences related to handedness of the gloves (left-and right-handedness).

Similarly, the yoga slippers 16 and 18 may be substantially identical to one another, except for left-right differences. Accordingly, the same reference numerals will be used herein to refer to corresponding parts of both the yoga gloves 12 and 14, and to refer to different parts of the yoga slippers 16 and 18.

The right-hand glove 12, shown in a palmar (front-of-the-hand) view in FIG. 1, illustrates a glove anti-skid material portion 22 that covers much of the palmar (front) side of the glove 12. A glove fabric portion 24, not coated or covered with anti-skid material, also covers a portion of the palmar side of the glove 12. The glove fabric portion 24 has a fabric exterior surface. The glove anti-skid material portion 22 includes a non-fabric anti-skid exterior surface, having a substantially higher coefficient of friction than the fabric exterior surface of the glove fabric portion 24.

As explained in greater detail below, the glove fabric portion 24 may include an inner portion of the thumb, closer to the midline of the hand than the outer portion of the thumb. As shown with reference to the glove 14, illustrated in FIG. 1 in dorsal (back-of-the-hand) view, the glove fabric portion 24 includes a dorsal part 26. The dorsal part 26 may encompass substantially all of the dorsal (back) side of the glove.

The right yoga slipper 16 and the left yoga slipper 18 provide an overview illustrating some aspects of the yoga slippers. The right yoga slipper 16, shown in FIG. 1, in an inside-of-the-foot view, includes a slipper upper fabric portion 36 and a slipper anti-skid material inside side portion 38. The left yoga slipper 18 illustrated in FIG. 1 in a outside-of-the-foot view, includes the slipper upper fabric portion 36 and a slipper anti-skid material outside side portion 40. As discussed in greater detail below, the side portions 38 and 40 may be utilized to maintain contact between anti-skid material and a floor or other surface when a yoga practitioner's foot is pronated or supinated.

Figure 2:
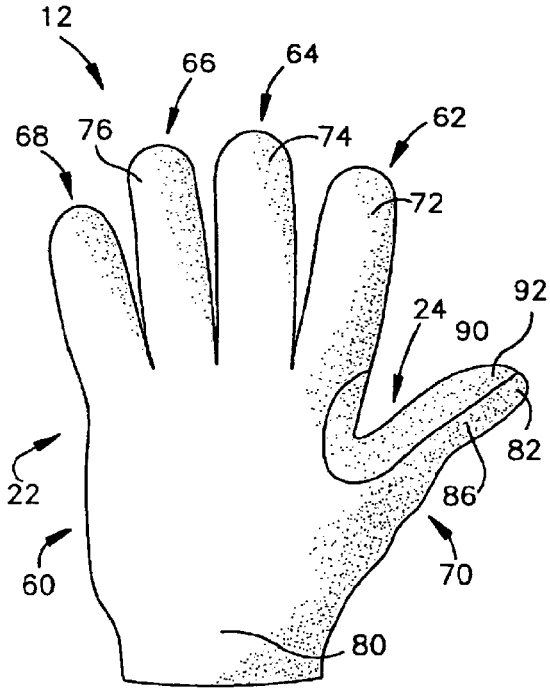
FIG. 2 is a palmar view of one of the gloves of the system of FIG. 1.
Figure 3:
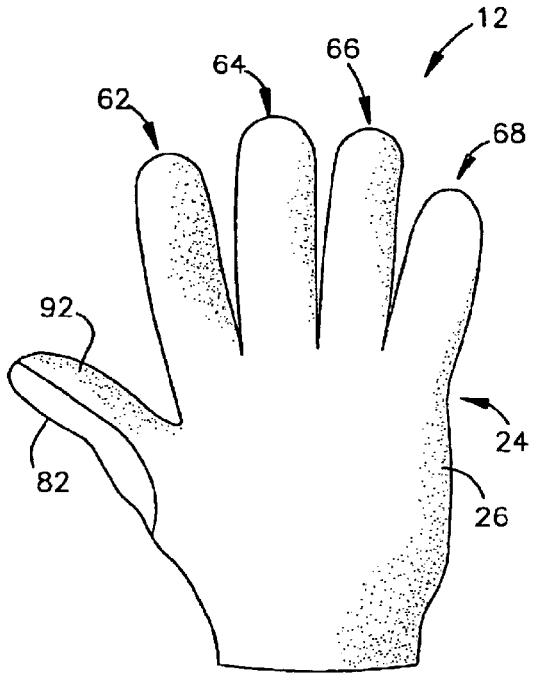
FIG. 3 is a dorsal view of the glove of FIG. 2.

Turning now to FIGS. 2 and 3, further details of the right glove 12 are now discussed. As noted above, it will be appreciated that corresponding details may be found in the left glove 14. FIG. 2 shows a palmar view of the glove 12, while FIG. 3 shows a dorsal view of the same glove 12. In the follow discussion, references are made to both parts of the glove 12 as well as to parts of the underlying hand of the wearer of the glove 12. It will be appreciated that such references are to some extent interchangeable, in that parts of the glove 12 overlie corresponding parts of the wearer's hand when the glove is worn by a wearer having a properly-sized hand (a hand for which the glove 12 corresponds in size).

The glove 12 includes a palm pocket 60 for receiving the palm of a yoga practitioner or other wearer, finger pockets 62, 64, 66, and 68 for receiving the fingers of the wearer, and a thumb pocket 70 for receiving the thumb of the wearer. The anti-skid material portion 22 may include parts on all of the portions of the front of the hand that contact and press against a flat surface, when a wearer presses against such a surface. Thus, the anti-skid material portion 22 has a palm part 80 covering the front of the palm pocket 60. In addition, the glove anti-skid material portion 22 may have finger pad parts 72, 74, 76, and 78, respectively corresponding to the front surfaces of the finger pockets 62, 64, 66, and 68. Further, the anti-skid material portion 22 has an outer thumb part 82 overlying the outer part of the wearer's thumb.

The outer part of the thumb, as used herein, indicates the side surface of the thumb (between the front pad surface of the thumb and the back, thumbnail-bearing surface of the thumb) that is farther away from the midline of the hand. The outer surface of the thumb includes a point (indicated in FIG. 2 by reference numeral 86) where a thumb bending axis would protrude from the wearer's thumb (or the thumb pocket 70). This thumb bending axis is the bending axis between the two phalanges (thumb bones) of the thumb as they bend relative to one another. The outer thumb part 82 of the anti-skid material portion 22 may include a portion that overlies the thumb bending axis 86. Indeed, the outer thumb part 82 may be located on the thumb of the glove such that the outer thumb part 82 of the anti-skid material portion 22 is substantially centered about the thumb bending axis 86. That is, the outer thumb part 82 may have substantially the same amount of material located forward of the thumb bending axis 86 (toward the front pad surface of the thumb), as is located aft of the thumb-bending axis 86 (towards the back, thumbnail-bearing surface of the thumb).

The outer thumb part 82 of the glove anti-skid material portion 22 aids in providing traction when a hand is pressed up against a flat surface. Thus, the glove 12 provides superior performance in a pressing operation, when compared with conventional gloves having gripping surfaces designed for grasping operations such as for grasping tools. Such grasping-designed gloves have grips on an inner surface of the thumb, as opposed to the outer surface as in the glove 12.

As noted above, the glove fabric portion 24 may cover substantially all of the back, dorsal side of the glove 12. In addition, the fabric portion 24 may include an inner thumb part 90 and a thumb pad part 92.

The glove fabric portion 24 may be made of a fabric that is lightweight, breathable, and/or elastic. It will be appreciated that these qualities enhance the experience of a yoga practitioner by maximizing comfort while wearing the glove 12. It will be appreciated that maximizing comfort is highly desirable for a glove worn for an activity such as yoga, that places a premium on intense concentration with a minimum of distraction. Use of a hot, heavy, or bulky glove may result in uncomfortable and unwanted distractions for a yoga practitioner.

Suitable materials for the glove fabric portion 24 include cotton, polyester, and cotton-polyester blends. Also, stretchable fabrics may be utilized, such as synthetic fabrics sold under the trademark LYCRA.

Figure 3A:
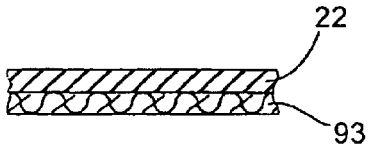
FIG. 3A is a cross-sectional view showing an anti-skid portion attached to a fabric underlayer of the glove of FIG. 2.

The glove anti-skid material portion 22 may include an anti-skid material attached to an underlying fabric 93, for example, being adhesively attached with a suitable adhesive as illustrated in FIG. 3A. Alternatively, or in addition, the glove anti-skid material portion 22 may be attached to an underlying material by other suitable means, for example, by stitching. The glove anti-skid material portion 22 may include any of a variety of suitable materials that provide an increased coefficient of friction, thereby preventing or discouraging sliding when the anti-skid material is pressed against the surface. Examples of suitable anti-skid materials include polyurethane foam, leather, and rubber.

The underlying fabric, to which the glove anti-skid material portion 22 is attached, may be part of a unitary glove, formed from a single material. Thus the underlying material may be the same material as that of the glove fabric portion 24. It will be appreciated that having a single underlying material glove may enhance the wearer's comfort, as well as providing for ease of manufacture.

Figure 4:
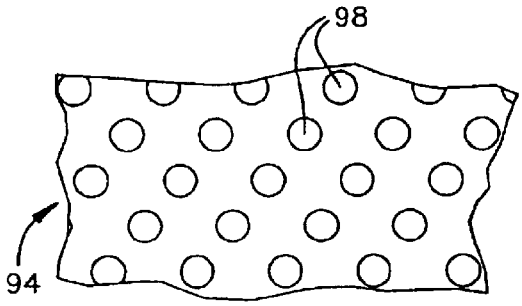
FIGS. 4–7 are plan views of various embodiment textured surfaces for use on the anti-skid portion of the glove of FIGS. 2 and 3.

The glove anti-skid material portion 22 may have a textured surface to increase its traction and enhance slipping prevention. One example of a textured surface 94 is shown in FIG. 4, wherein anti-skid material has raised protrusions 98. These protrusions may be raised from a thinner part of anti-skid material. Alternatively, the protrusions 98 may be placed directly on underlying fabric, providing some degree of breathability and enhanced flexibility for the anti-skid material. The protrusions may be any of a variety of suitable shapes, such as hemispherical or cylindrical.

Figure 5:
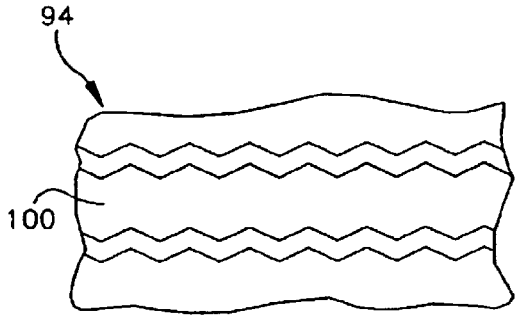

Another for the textured surface 94 is a treaded surface, such as a treaded surface 100 shown in FIG. 5. The treaded surface 100 utilizes grooves and/or ridges to enhance gripping. It will be appreciated that a wide variety of suitable tread patterns may be utilized. The tread pattern may enhance gripping substantially equally in all directions. Alternatively, the tread may provide more enhancement of gripping in one direction than in another direction.

Figure 6:
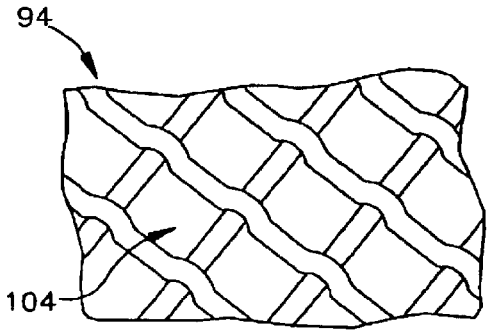

Yet another example of a textured surface 94 is shown in FIG. 6, wherein the anti-skid material involves an interlocking pattern 104 of suitable material, such as rubber.

Figure 7:
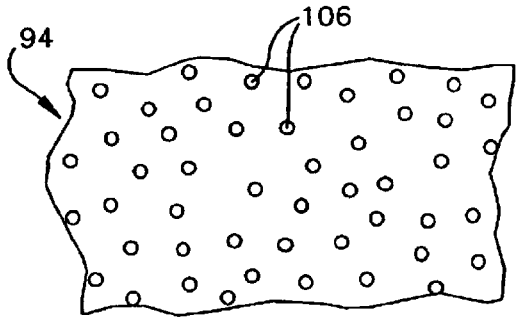

A further example of a textured surface is shown in FIG. 7, wherein the anti-skid material includes embedded grit particles 106, such as sand particles.

The glove anti-skid material portion 22 may be a continuous, unitary material, for example, cut out of a single sheet of anti-skid material. Alternatively, it will be appreciated that the anti-skid material portion 22 may have multiple parts, for example, having separate parts for each of the finger pad parts 72–78.

As noted above, the glove 12 advantageously provides a lightweight means or prevent hand slippage, without unduly burdening the yoga practitioner, thereby allowing the yoga practitioner to attain and maintain postures that involve pressing the hands against rigid, flat surfaces. Accordingly, it will be recognized that is advantageous to maximize the size of the glove fabric portion 24 relative to the glove anti-skid material portion 22, while at the same time maintaining desirable gripping properties and maintaining integrity of the glove 12. Therefore, in particular, the desirability will be evident of having the inner thumb part 90 of the glove 12 be part of the glove fabric portion 22, rather than being covered with anti-skid material. Further, having the inner thumb 90 be part of the glove fabric portion 24 aids in flexibility for the yoga practitioner.

It will be appreciated that many suitable configurations for the glove anti-skid material portion 22 and the glove fabric portion 24 may be utilized, beyond the variations described above and shown in the figures.

Figure 8:
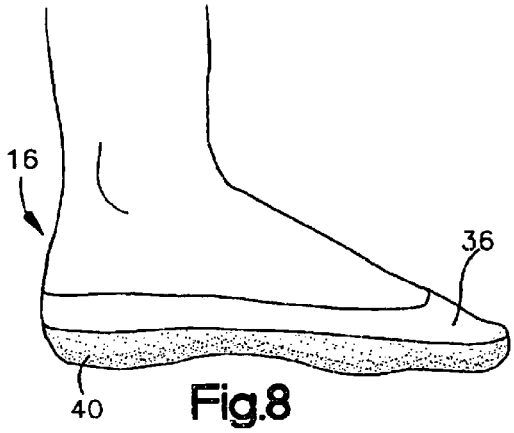
FIG. 8 is an outside foot view of one of the slippers of the system of FIG. 1.
Figure 9:
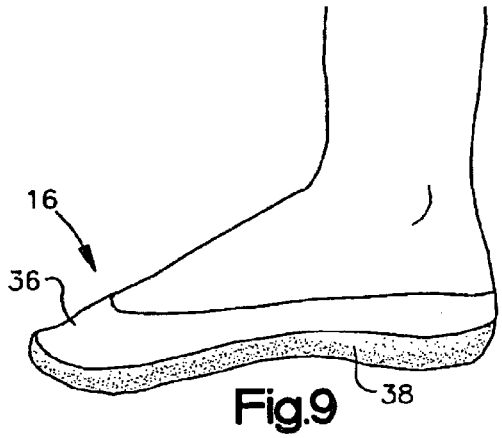
FIG. 9 is an inside foot view of the slipper of FIG. 8.
Figure 10:
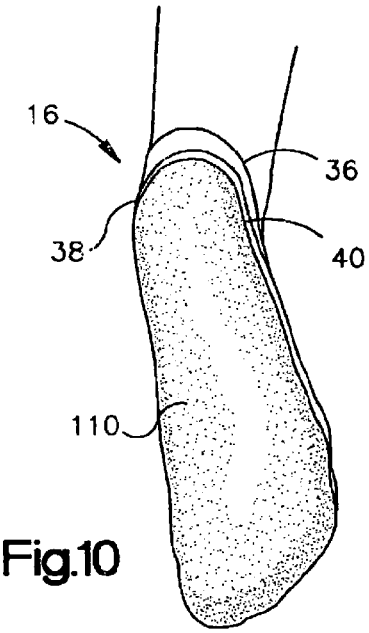
FIG. 10 is a bottom angled view of the slipper of FIG. 8.

Turning now to FIGS. 8–10, various view of the right slipper 16 are shown. The yoga slipper 16 includes an anti-skid sole portion 110 made of an anti-skid material. Anti-skid material on the sole portion 110 aids in maintaining foot position when the foot is pressed flat against a rigid surface, such as a floor.

In addition, the yoga slipper 16 includes anti-skid material on the side portions 38 and 40. The inside (distal) side portion 38 provides anti-skid-material along a lower part of the inside of the foot, and the outside (proximal) side portion 40 provides anti-skid material along a lower portion of the outside of the yoga practitioner's foot. The anti-skid side portions 38 and 40 aid in preventing slipping of a foot when the foot is pronated or supinated and pressed against a surface. The slipper 16 also includes the slipper upper fabric portion 36.

The sole portion 110 may be made of the same anti-skid material as the side portions 38 and 40. Alternatively, the sole portion 110 may include a different anti-skid material than the side portions 38 and 40. For example, the sole portion 110 may be made of leather, with the side portions 38 and 40 being made of a rubber material. As another alternative, the sole portion 110 may be made of a thicker layer of the same anti-skid material as the side portions 38 and 40. This may be due to the desirability to provide increased protection along the sole portion 110 for walking by the yoga practitioner, as well as to provide increased wear for the sole portion 110, such that it will be expected that the sole portion 110 will be subject to more wear than the side portions 38 and 40. The slipper upper fabric portion 36 may be made of the same material as the glove fabric portion 24. Alternatively, the slipper upper fabric portion 36 and the glove fabric portion 24 may be made of different materials.

The side portions 38 and 40 may extend up to a level approximately that of the top of the toes of the wearer of the slipper 16. Alternatively, the level of the side portions 38 and 40 may be higher or lower, for example, being at a level of about mid-toe height.

The sole portion 110 and the side portions 38 and 40 may have anti-skid materials similar to the suitable materials and textures described above for the glove anti-skid portion 22. The anti-skid portions 38, 40, and 110 may be adhesively or otherwise attached to a fabric underlayer.

The sole portion 110 and the side portions 38 and 40 may be parts of a unitary continuous anti-skid material along the bottom and sides of the yoga slipper 16. Alternatively, the portions 38, 40, and 110 may include multiple pieces of anti-skid material. The side portions 38 and 40 may be parts of a single piece, or may be separate. The slipper 16 may have an open top, similar to that used as ballet slippers, leaving at least part of a top surface of the wearer's foot uncovered.

It will be appreciated that, as with the glove 12, described earlier, it will be advantageous to have the slipper 16 provide flexibility and light weight so as to be unobtrusive to the wearer, while maintaining the desired characteristics of gripping of the foot along the sole and sides, and achieving long life and integrity of the slipper 16.

Using the yoga support set 10, it is possible to dispense altogether with use of a yoga mat or rug. The yoga support set 10 weighs less and is less bulky than a mat or rug. In addition, the gloves 12 and 14 and the slippers 16 and 18 move with the yoga practitioner as he or she practices yoga. Thus, there is no need to align oneself with a mat, which may be a concern otherwise.

Figure 11:
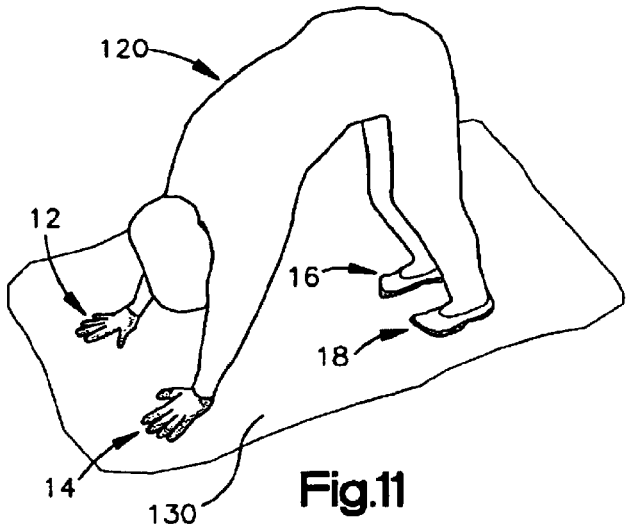
FIGS. 11–13 illustrate various yoga positions achieved using the system of FIG. 1, by a method in accordance with the present invention.
Figure 12:
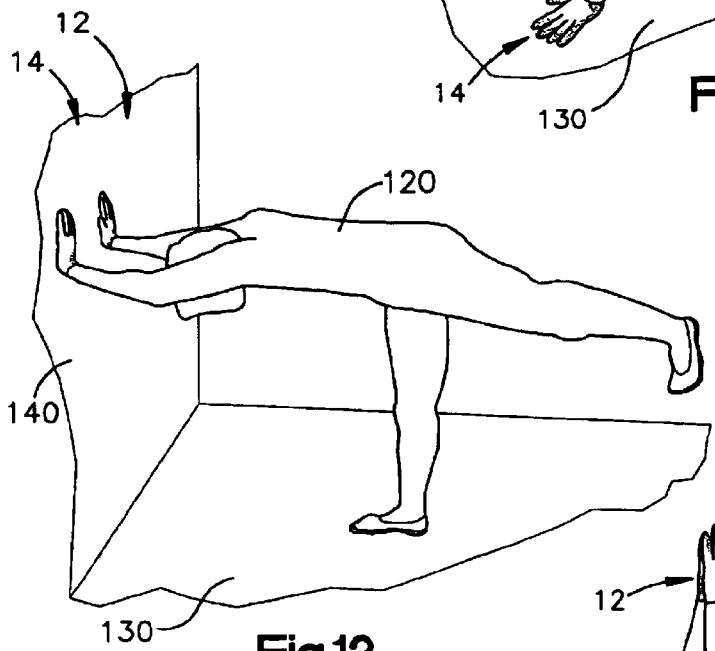
Figure 13:
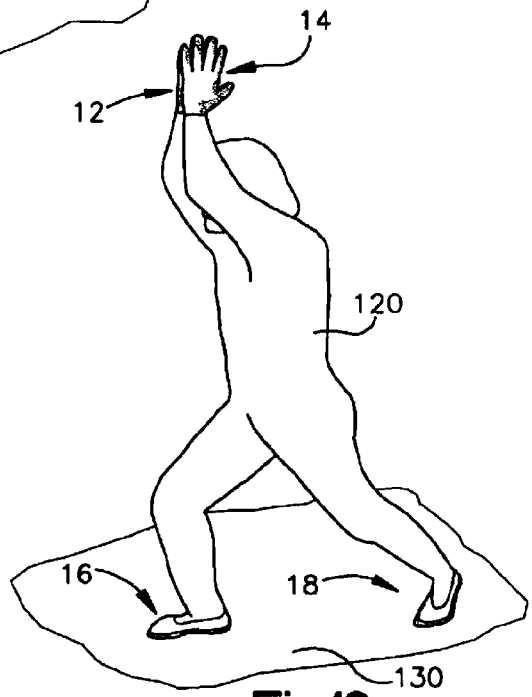

FIGS. 11–13 show the yoga support system 10 being utilized in a few sample yoga positions or postures. FIG. 11 illustrates what is known as the downward-facing dog posture, or adhomukha shvanasana. In such a posture, the yoga practitioner 120 places both hands and feet on a floor 130 or other similar rigid surface, such as a platform. In utilizing the yoga support set 10, the anti-skid material portions 22 of the gloves 12 and 14 maintain the hands of the user on the floor 130, and the anti-skid sole portions 110 of the yoga slippers 16 and 18 maintain the feet of the yoga practitioner on the floor 130.

Turning now to FIG. 12, a yoga posture known as the warrior at the wall (vira vhadrasana III variation) is illustrated. Here the yoga practitioner places the anti-skid material portions of both of the gloves 12 and 14 up against a wall 140 or other rigid surface, while placing the sole of one of the yoga slippers 16 against the floor 130. It will be appreciated that a yoga mat or rug is of no use in maintaining the hands against the wall when performing such a posture. However, the gloves 12 and 14 advantageously aid in maintaining hand contact with the wall 140, without slippage.

It will be appreciated that the gloves 12 and 14 may be used independent of the slippers 16 and 18, for example in conjunction with a mat or rug, to prevent hand slippage for yoga postures involving hand contact with a wall.

FIG. 13 illustrates a yoga posture known as the warrior posture, the vira vhadrasana. This posture involves contacting the floor 130 with the side of one of the slippers. Thus, the inside foot side portion 38 of one of the slippers 18 (not visible in FIG. 13) is utilized in maintaining the position of the yoga practitioner 120.

It will be appreciated that the yoga positions shown in FIGS. 11–13 and described above, are but a few of many yoga positions and postures that are well known to yoga practitioners.

The gloves and slippers described and shown in the figures, then, provide numerous advantages relative to yoga mats and rugs presently in use. One advantage is their light weight and compactness, which make them easier to transport and travel with than yoga mats and rugs. A second advantage is they remove the possibility of a practitioner accidentally moving off of the stationary mat or rug. The gloves 12 and 14 and the slippers 16 and 18 move with the user, and provide certainty that the gripping surfaces are always present where they will be needed. A third advantage is that the gloves and slippers provide gripping against surfaces other than floors, such as walls. Rugs and mats are placed on the floor and provide no support for preventing slippage against a wall or other surface. Finally, the gloves 12 and 14 and the slippers 16 and 18 advantageously provide a flexible, light weight and unobtrusive means for gripping. Heavier gloves, such as work gloves or gardening gloves, may be substantially alter the tactical sensations perceived by the yoga practitioner, thus interfering with the concentration necessary for proper practice of yoga.

It will be appreciated that the gloves 12 and 14 and the slippers 16 and 18 may be employed for other uses besides yoga. For example, the gloves and/or the slippers may be used for reducing or avoiding slippage during a wide variety of activities that involve pushing from a stationary position.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A glove comprising:

a fabric portion having a fabric exterior surface throughout; and an anti-skid portion having an anti-skid exterior surface throughout;

wherein the fabric portion is connected to the anti-skid portion;

wherein the fabric portion includes a dorsal part;

wherein the anti-skid portion includes an outer thumb part;

wherein the outer thumb part overlies a thumb bending axis; and wherein the outer thumb part is substantially centered about the thumb bending axis.

2. A glove comprising:

a fabric portion having a fabric exterior surface throughout; and an anti-skid portion having an anti-skid exterior surface throughout;

wherein the fabric portion is connected to the anti-skid portion;

wherein the fabric portion includes a dorsal part;

wherein the anti-skid portion includes an outer thumb part;

as part of a yoga support system that includes a pair of the gloves and a pair of yoga slippers, wherein the yoga slippers each include:

a slipper fabric portion having a slipper fabric exterior surface throughout; and a slipper anti-skid portion with a slipper anti-skid exterior surface throughout;

wherein the slipper anti-skid portion includes a sole part, and a pair of side parts overlying both sides of the foot of a user; and wherein the side parts extend along substantially all of both sides of the slipper at a level of at least mid-toe height of a wearer.

3. A method of performing yoga, comprising:

placing a pair of gloves on respective hands of a yoga practitioner, wherein the gloves each includes a glove anti-skid portion having an anti-skid exterior surface throughout;

placing a pair of slippers on respective feet of the yoga practitioner, wherein the slippers each include a slipper anti-skid exterior surface, wherein the side parts of the slipper anti-skid exterior surface extend along substantially all of both sides of the slipper at a level of at least mid-toe height of a wearer; and having the yoga practitioner assume a yoga position;

wherein the having includes placing the glove anti-skid surfaces in contact with a rigid surface; and wherein the having includes placing the slipper anti-skid exterior surfaces in contact with a floor.

4. The method of claim 3, wherein the rigid surface is a floor.

5. The method of claim 3, wherein the rigid surface is a wall.

6. The method of claim 3, wherein the having includes placing outer thumb parts of the gloves against the rigid surface.

7. The method of claim 3, wherein each of the gloves further includes a fabric portion having a fabric exterior surface throughout;

wherein the fabric portion is connected to the anti-skid portion;

wherein the fabric portion includes a dorsal part;

wherein the ant-skid portion includes an outer thumb part; and wherein the fabric portion also includes a thumb pad part.

8. The method of claim 3, wherein each of the gloves further includes a fabric portion having a fabric exterior surface throughout; and wherein the fabric portion is connected to the anti-skid portion;

wherein the fabric portion includes a dorsal part;

wherein the anti-skid portion includes an outer thumb part;

wherein the anti-skid portion includes an anti-skid material that is attached to a fabric underdayer; and wherein the anti-skid material is a continuous, unitary layer.

9. A yoga support system comprising:

a pair of yoga gloves and a pair of yoga slippers;

wherein the yoga gloves and the yoga slippers are configured for use simultaneously by a yoga practitioner to prevent slipping by the yoga practitioner, wherein each of the gloves includes:

a glove fabric portion; and a glove anti-skid portion connected to the glove fabric portion;

wherein the glove fabric portion is connected to the glove anti-skid portion; and wherein each of the yoga slippers includes:

a slipper fabric portion having a slipper fabric exterior surface throughout; and a slipper anti-skid portion with a slipper anti-skid exterior surface throughout;

wherein the slipper anti-skid portion is connected to the slipper fabric portion;

wherein the slipper anti-skid portion includes a sole part, and a pair of side parts overlying both sides of the foot of a user; and wherein the side parts extend along substantially all of both sides of the slipper at a level of at least mid-toe height of a wearer.

10. The system of claim 9, wherein the glove anti-skid portion includes an outer thumb part; and wherein the glove fabric portion includes an inner thumb part.

11. The system of claim 10, wherein the glove fabric portion further includes a dorsal part.

12. The system of claim 9, wherein:

the fabric portion of each of the gloves also includes a thumb pad part.

13. The system of claim 9, wherein:

the anti-skid portion of each of the gloves is a continuous, unitary layer.

14. The system of claim 9, wherein the glove fabric portion has a fabric exterior surface throughout;

wherein the glove anti-skid portion has an anti-skid exterior surface throughout;

wherein the glove fabric portion includes a dorsal part;

wherein the glove anti-skid portion includes an outer thumb part; and wherein the glove anti-skid portion includes an anti-skid material that is attached to a fabric underlayer.

15. The system of claim 14, wherein the glove anti-skid portion also includes a palm part.

16. The system of claim 14, wherein the glove anti-skid portion also includes finger pad surfaces of the glove.

17. The system of claim 14, wherein the glove fabric portion also includes an inner thumb part.

18. The system of claim 14, wherein the fabric underlayer and the glove fabric portion are parts a continuous, unitary layer of a fabric material.

19. The system of claim 18, wherein the fabric material is breathable.

20. The system of claim 18, wherein the fabric material is stretchable.

21. The system of claim 14, wherein the anti-skid material is adhesively bonded to the fabric underlayer.

22. The system of claim 14, wherein the glove anti-skid portion includes rubber.

23. The system of claim 14, wherein the glove anti-skid portion includes polyurethane foam.

24. The system of claim 14, wherein the anti-skid exterior surface of the glove anti-skid portion has a textured surface.

25. The system of claim 24, wherein the textured surface includes grit particles.

26. The system of claim 24, wherein the textured surfaced includes a treaded surface.

27. The system of claim 14, wherein the glove anti-skid material is a continuous, unitary layer.

* * * * *